US006800412B2

(12) United States Patent
Sugiyama et al.

(10) Patent No.: US 6,800,412 B2
(45) Date of Patent: Oct. 5, 2004

(54) TONER FOR DRY DEVELOPING

(75) Inventors: Tsunemi Sugiyama, Numazu (JP); Masami Tomita, Numazu (JP); Shigeru Emoto, Numazu (JP); Hiroshi Yamashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/681,185

(22) Filed: Oct. 9, 2003

(65) Prior Publication Data

US 2004/0076899 A1 Apr. 22, 2004

Related U.S. Application Data

(63) Continuation of application No. 09/986,023, filed on Nov. 7, 2001, now Pat. No. 6,682,866.

(30) Foreign Application Priority Data

Nov. 8, 2000 (JP) ..... 2000-339842
Aug. 10, 2001 (JP) ..... 2001-243739

(51) Int. Cl.[7] ..... G03G 9/00
(52) U.S. Cl. ..... 430/108.1; 430/108.8; 430/109.4
(58) Field of Search ..... 430/108.1, 108.8, 430/109.4

(56) References Cited

U.S. PATENT DOCUMENTS 5,905,010 A 5/1999 Nakamura et al.
5,935,751 A 8/1999 Matsuoka et al.
5,998,074 A 12/1999 Miyamoto et al.
6,103,441 A 8/2000 Tomita et al.
6,255,028 B1 7/2001 Hasegawa et al.
6,335,137 B1 1/2002 Suzuki et al.
6,360,068 B1 3/2002 Kinoshita et al.
6,363,229 B1 3/2002 Shiraishi et al.
6,395,443 B2 5/2002 Kuroda et al.
6,403,275 B1 6/2002 Kuramoto et al.
6,432,589 B1 8/2002 Uchinokura et al.
6,492,079 B2 12/2002 Shimada et al.
6,660,443 B2 12/2003 Sugiyama et al.
6,682,866 B2 * 1/2004 Sugiyama et al. ..... 430/108.1

FOREIGN PATENT DOCUMENTS

EP 1 011 031 6/2000
EP 1 026 554 8/2000

OTHER PUBLICATIONS

Database WPI, Derwent Publications, Accession No. 1998–31772, XP–002193458, JP 10–115949, May 6, 1998.
Patent Abstracts of Japan, JP 10–115951, May 6, 1998.
Patent Abstracts of Japan, JP 11–1133667, May 21, 1999.
Patent Abstracts of Japan, JP 11–133666, May 21, 1999.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A toner for dry developing, containing a colorant, a binder including a modified polyester, and wax particles dispersed in the binder, wherein that portion of the wax particles having a dispersion diameter of 0.1-3 $\mu$m accounts for at least 70% by number of the wax particles.

21 Claims, No Drawings

TONER FOR DRY DEVELOPING

This application is a continuation of Ser. No. 09/986,023 Nov. 7, 2001, now U.S. Pat. No. 6,682,866.

BACKGROUND OF THE INVENTION

This invention relates to a dry toner for developing electrostatic images in electrophotography, electrostatic recording and electrostatic printing. More specifically, the present invention is directed to a dry toner used in full color or monochromatic copying machines, full color or monochromatic laser printers, full color or monochromatic facsimile machines and the like image forming machines.

Dry toner for use in the above image forming machines are desired to have the following characteristics:

(1) Freedom of Hot Offset:

"Hot offset" is a phenomenon occurring in fixation of toner image on paper with a heated roll and refers to deposition of fused toner onto the heated roll. Conventionally, an oil is applied to a heated roll to improve releasability. This requires an oil tank and hinders compactness of the apparatus. Recent trend is toward incorporation of a wax into the toner.

(2) Capability of Fixing at Low Temperature:

For reasons of energy saving, it is desired that the toner image be sufficiently fixed at a low temperature.

(3) Freedom of Toner Filming:

"Filming" is a phenomenon occurring when a wax is incorporated into dry toner to improve releasability thereof from a heated roll and refers to transference of the wax to a photoconductor or carrier particles to form a film thereon.

(3) Good Fluidity:

Toner is desired to have a small particle size for obtaining high grade toner images. However, fine toner particles generally have random shapes and fail to exhibit good fluidity. Good fluidity of toner is desired to increase the amount thereof chargeable in a toner bottle and to reduce the amount of a fluidizing agent.

(4) Good Transferability:

Toner image on a photoconductor must be transferred to a transfer medium with high efficiency to obtain high quality image.

Known toner, however, fails to simultaneously attain the above characteristics. For example, to attain low temperature fixation and anti-hot offset, JP-A-S57-109825 proposes the use of a polyester partially crosslinked with a polyfunctional monomer as a toner binder and JP-B-H07-101318 proposes the use of an urethane-modified polyester as a toner binder. These toners, however, do not exhibit satisfactory fluidity and transferability.

JP-A-H07-56390 proposes a toner containing polyester particles and wax particles to reduce the amount of a silicone oil which is applied to a heated fixing roll to prevent hot offset. The proposed toner, however, fails to attain satisfactory fluidity, transferability and low temperature fixation.

To improve fluidity and transferability, JP-A-H09-43909 proposes a toner obtained by a method in which an aqueous dispersion containing a colorant, a polar resin and a releasing agent is subjected to suspension polymerization; and JP-A-H09-34167 proposes a toner obtained by treating toner particles containing a polyester resin with an organic solvent in water. The former proposal, however, fails to attain low temperature fixation, while the latter proposal fails to improve anti-hot offset.

JP-A-H11-133666 proposes a dry toner using a urea-modified polyester resin as a toner binder. While the proposed toner gives good releasability and suitable gloss, anti-hot offset is not satisfactory.

JP-H10-207116 proposes a toner having a controlled amount of a wax exposed to the external surfaces thereof and a specific particle diameter. The proposed toner, however, causes filming of spent toner.

SUMMARY OF THE INVENTION

It is, therefore, an object of the present invention to provide a dry toner which is devoid of the drawbacks of conventional toners.

Another object of the present invention is to provide a toner which exhibits sufficient anti-hot offset, which permit low temperature fixation, which is free of toner filming problems and which has good fluidity and good transferability.

In accordance with the present invention, there is provided a toner for dry developing, comprising a colorant, a binder including a modified polyester, and wax particles dispersed in said binder, wherein that portion of said wax particles having a dispersion diameter of 0.1–3 $\mu$m accounts for at least 70% by number of said wax particles.

The "dispersion diameter of wax particle" as used herein refers to the maximum length of a line extending between two points on the peripheral line of the TEM pattern of the particle. TEM pattern is obtained as follows. A sample toner is embedded in an epoxy resin and the embedded body is cut into a slice having a thickness of about 100 nm. The slice is dyed with ruthenium tetraoxide and a cross-sectional photograph (magnification: 10,000) is taken using a transmission electron microscope.

Other objects, features and advantages of the present invention will become apparent from the detailed description of the preferred embodiments of the invention to follow.

DETAILED DESCRIPTION OF THE PREFERRED EMBODIMENTS OF THE INVENTION

A toner according to the present invention comprises wax particles, a colorant, and a binder including a modified polyester.

It is important that the wax particles have such a particle size distribution that portion of the wax particles having a dispersion diameter of 0.1–3 $\mu$m accounts for at least 70% by number of the wax particles. Preferably, that portion of the wax particles having a dispersion diameter of 1–2 $\mu$m accounts for at least 70% by number of the wax particles. When wax particles having a dispersion diameter of less than 0.1 $\mu$m are present in excess of 30% by number of the whole wax particles, satisfactory releasability cannot be attained. On the other hand, when wax particles having a dispersion diameter of more than 3 $\mu$m are present in excess of 30% by number of the whole wax particles, fluidity of the resulting toner becomes poor and filming is apt to occur and, further, color reproducibility and gloss of the color images are not satisfactory.

Any wax may be suitably used for the purpose of the present invention. Examples of such waxes include polyolefin wax such as polyethylene wax and polypropylene wax; long chain hydrocarbon wax such as paraffin wax and sazole wax; and carbonyl group-containing wax. The carbonyl group-containing wax is particularly preferably used for the purpose of the present invention.

Illustrative of suitable carbonyl group-containing waxes are polyalkanoic acid ester waxes such as carnauba wax, montan wax, trimethylolpropane tribehenate, pentaerythritol tetrabehenate, pentaerythritol diacetate dibehenate, glycerin tribehenate and 1,18-octadecanediol distearate; polyalkanol ester waxes such as tristearyl trimellitate and distearyl maleate; polyalkanoic acid amide waxes such as ethylenediamine dibehenyl amide; polyalkylamide waxes such as trimellitic acid tristearyl amide; and dialkyl ketone waxes such as distearyl ketone. Above all, the use of a polyalkanoic acid ester wax is preferred.

The wax used in the present invention generally has a melting point of 40–160° C., preferably 50–120° C., more preferably 60–90° C. A melting point of wax below 40° C. may adversely affect the heat resistance and preservability of the toner, while too high a melting point in excess of 160° C. is apt to cause cold offset of toner when the fixation is performed at a low temperature. Preferably, the wax has a melt viscosity of 5–1000 cps, more preferably 10–100 cps, at a temperature higher by 20° C. than the melting point thereof. When the viscosity is greater than 1000 cps, the anti-hot offset properties and low fixation properties of the toner are adversely affected. The amount of the wax in the toner is generally 1–40% by weight, preferably 3–30% by weight, based on the weight of the toner.

It has been found that the wax particles having suitable particle diameters can be dispersed in a modified ester-containing binder resin in a stable manner. Probably, the polar regions of the modified polyester provide negative adsorption in the interface between the wax and the polar regions so that non polar wax particles can be stably dispersed in the polyester.

The modified polyester used as a binder is (A) a polyester resin containing one or more groups other than (a) the functional groups of the monomer units (diol units and dicarboxylic acid units from which the polyester is constructed) and (b) the ester linkages of the polyester, or (B) a polyester resin to which a different polymer is bonded through ionic bonding or covalent bonding.

Thus, the modified polyester may be a polyester whose terminus is modified with a functional group, such as an isocyanate group, capable of reacting with a carboxylic or hydroxyl group. The functional group may be further reacted with a compound having one or more active hydrogen atoms. In this case, when the compound has a plurality of active hydrogen (such as diamines and diols), two or more polyesters are linked together. Urea-modified polyester and urethane-modified polyester are illustrative of such modified polyesters.

The modified polyester may also be a graft polymer-modified or cross-linked polyester obtained by introducing a reactive group such as an unsaturated group. The unsaturated group thus introduced is further reacted by, for example, radical polymerization to form graft side chain or chains. Alternatively, two such unsaturated groups may be cross-linked. Styrene-modified polyester and acryl-modified polyester are illustrative of such modified polyesters.

Further, the modified polyester may be a polyester which is copolymerized or reacted with another resin. One example of such a modified polyester is a silicone-modified polyester obtained by reacting a polyester with a silicone resin whose terminus has been modified with a carboxyl group, hydroxyl group, epoxy group or mercapto group.

Preferably used as the modified polyester is a urea-modified polyester of which description will be next made in detail.

The urea-modified polyester may be suitably prepared by reacting an isocyanate-containing polyester prepolymer with an amine. The isocyanate-containing polyester prepolymer may be obtained by reacting a polyisocyanate with a polyester which is prepared by polycondensation of a polyol with a polyacid and which has an active hydrogen. Examples of active hydrogen-containing groups include a hydroxyl group (alcoholic OH or phenolic OH), an amino group, a carboxyl group and a mercapto group.

The polyol may be a diol or a tri- or more polyhydric alcohol. A mixture of a diol with a minor amount of a tri- or more polyhydric alcohol is preferably used.

As the diol to be used for the preparation of the base polyester, any diol employed conventionally for the preparation of polyester resins can be employed. Preferred examples include alkylene glycols such as ethylene glycol, 1,2-propylene glycol, 1,3-propylene glycol, 1,3-butylene glycol, 1,4-butylene glycol, 2,3-butanediol, diethylene glycol, triethylene glycol, dipropylene glycol, 1,5-pentanediol, 1,6-hexanediol, neopentyl glycol and 2-ethyl-1,3-hexanediol; alkyleneether glycols such as diethylene glycol, triethylene glycol, dipropylene glycol, polyethylene glycol, polypropylene glycol and polytetramethylene ether glycol; alicyclic glycols such as 1,4-cyclohexane dimethanol and hydrogenated bisphenol A; bisphenols such as bisphenol A, bisphenol F and bisphenol S; alkylene oxide adducts (e.g. ethylene oxide, propylene oxide and butylene oxide adducts) of the above alicyclic diols; and alkylene oxide adducts (e.g. ethylene oxide, propylene oxide and butylene oxide adducts) of the above bisphenols. Above all, alkylene glycols having 2–12 carbon atoms and alkylene oxide adducts of bisphenols are preferred. Especially preferred is the use of a mixture of alkylene glycols having 2–12 carbon atoms with alkylene oxide adducts of bisphenols.

Examples of the polyol having three or more hydroxyl groups include polyhydric aliphatic alcohols such as glycerin, 2-methylpropane triol, trimethylolpropane, trimethylolethane, pentaerythritol, sorbitol and sorbitan; phenol compounds having 3 or more hydroxyl groups such as trisphenol PA, phenol novolak and cresol novolak; and alkylene oxide adducts of the phenol compounds having 3 or more hydroxyl groups.

The polyacid may be a dicarboxylic acid, tri- or more polybasic carboxylic acid or a mixture thereof.

As the dicarboxylic acid to be used for the preparation of the base polyester, any dicarboxylic acid conventionally used for the preparation of a polyester resin can be employed. Preferred examples include alkyldicarboxylic acids such as malonic acid, succinic acid, glutaric acid, adipic acid, azelaic acid and sebacic acid; alkenylene dicarboxylic acids such as maleic acid, fumaric acid, citraconic acid and itaconic acid; and aromatic dicarboxylic acids such as phthalic acid, terephthalic acid, isophthalic acid and naphthalene dicarboxylic acid. Above all, alkenylene dicarboxylic acids having 4–20 carbon atoms and aromatic dicarboxylic acids having 8–20 carbon atoms are preferably used.

Examples of tri- or more polybasic carboxylic acids include aromatic polybasic carboxylic acids having 9–20 carbon atoms such as trimellitic acid and pyromellitic acid.

The polyacids may be in the form of anhydrides or low alkyl esters (e.g. methyl esters, ethyl esters and isopropyl esters).

In the formation of the polyester, the polyacids and the polyols are used in such a proportion that the ratio [OH]/[COOH] of the equivalent of the hydroxyl groups [OH] to the equivalent of the carboxyl groups [COOH] is in the range of generally 2:1 to 1:1, preferably 1.5:1 to 1:1, more preferably 1.3:1 to 1.02:1.

Examples of the polyisocyanate compound reacted with the polyester include aliphatic polyisocyanates such as tetramethylene diisocyanate, hexamethylene diisocyanate and 2,6-diisocyanate methylcaproate; alicyclic polyisocyanates such as isophorone diisocyanate, cyclohexylmethane diisocyanate; aromatic diisocyanate such as xylylene diisocyanate, tolylene diisocyanate, diphenylmethane diisocyanate and α,α,α',α'-tetramethylxylylene diisocyanate; isocyanurates; the above polyisocyanates blocked or protected with phenol derivatives, oximes or caprolactams; and mixtures thereof.

The polyisocyanate is used in such an amount that the ratio [NCO]/[OH] of the equivalent of the isocyanate groups [NCO] to the equivalent of the hydroxyl groups [OH] of the polyester is in the range of generally 5:1 to 1:1, preferably 4:1 to 1.2:1, more preferably 2.5:1 to 1.5:1. A [NCO]/[OH] ratio of over 5:1 tends to adversely affect low temperature fixation properties of the resulting toner. Too small a [NCO]/[OH] ratio of less than 1 tends to adversely affect anti-hot offset properties of the resulting toner.

The isocyanate group-containing polyester prepolymer generally has a content of the polyisocyate unit in the range of 0.5–40% by weight, preferably 1–30% by weight, more preferably 2–20% by weight. Too small an isocyanate group content of less than 0.5% tends to adversely affect anti-hot offset properties and to pose a difficulty in simultaneously obtaining satisfactory low temperature fixation properties and heat-resisting preservability of the resulting toner. When the isocyanate group content exceeds 40% by weight, the low temperature fixation properties of the resulting toner tends to be adversely affected.

The average number of the isocyanate groups contained in the prepolymer molecule is generally at least 1, preferably 1.5–3, more preferably 1.8–2.5. Too small a isocyanate group number less than 1 will result in a urea-modified polyester having an excessively small molecular weight so that the anti-hot offset properties of the toner will be adversely affected.

Examples of the amine to be reacted with the isocyanate group-containing polyester prepolymer for the formation of the urea-modified polyester include diamines, polyamines having 3 or more amino groups, aminoalcohols, aminomercaptans, amino acids and blocked or protected derivatives thereof.

Illustrative of suitable diamines are aromatic diamines such as phenylenediamine, diethytoluenediamine and 4,4'-diaminodiphenylmethane; alicyclic diamines such as 4,4'-diamino-3,3-dimethylcyclohexylmethane, diaminocyclohexane and isophoronediamine; and aliphatic diamines such as ethylenediamine, tetramethylenediamine and hexamethylenediamine. Illustrative of suitable polyamines having 3 or more amino groups are diethylenetriamine and triethylenetetramine. Illustrative of suitable aminoalcohols are ethanolamine and hydroxyethylaniline. Illustrative of suitable aminomercaptans are aminoethylmercaptan and aminopropylmercaptan. Illustrative of suitable amino acids are aminopropionic acid and aminocaproic acid. Illustrative of suitable blocked derivatives of the above diamines, polyamines having 3 or more amino groups, aminoalcohols, aminomercaptans and amino acids are ketimines obtained by interacting the amines with a ketone such as acetone, methyl ethyl ketone or methyl isobutyl ketone. Oxazolidine compounds may be also used as the blocked derivatives. Especially preferred amine is an aromatic diamine or a mixture of an aromatic diamine with a minor amount of a polyamine having 3 or more amino groups.

If desired, a chain extension terminator may be used to control the molecular weight of the urea-modified polyester. Examples of the chain extension terminators include monoamines such as diethylamine, dibutylamine, butylamine and laurylamine. Blocked or protected monomines such as ketimines may be also used as the terminator.

The amine is reacted with the isocyanate group-containing polyester prepolymer in such an amount that the ratio [NCO]/[$NH_x$] of the equivalent of the isocyanate groups [NCO] of the prepolymer to the equivalent of the amino groups [$NH_x$] of the amine is in the range of generally 1:2 to 2:1, preferably 1.5:1 to 1:1.5, more preferably 1.2:1 to 1:1.2. A [NCO]/[$NH_x$] ratio over 2:1 or less than 1:2 will result in a urea-modified polyester having an excessively small molecular weight so that the anti-hot offset properties of the toner will be adversely affected.

One specific example of a method of producing the urea-modified polyester is as follows. A polyol and a polyacid are reacted with each other in the presence of an esterification catalyst such as tetrabutoxytitanate or dibutyltin oxide at a temperature of 150–280° C. The reaction may be carried out under a reduced pressure while removing water produced in situ, if desired. The resulting hydroxyl group-containing polyester is reacted with a polyisocyanate at 40–140° C. in the presence or absence of a solvent to obtain an isocyanate-containing prepolymer. The prepolymer is reacted with an amine at 0–140° C. in the presence or absence of a solvent to obtain a urea-modified polyester. Any solvent inert to the polyisocyanate may be used. Examples of the solvents include aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

The urea-modified polyester may contain an urethane linkage, if desired. The content of the urethane linkage is generally up to 90 mole %, preferably up to 80 mole %, more preferably up to 70 mole %, based on total of the urethane and urea linkages. Too large an amount of the urethane linkage above 90 mole % may adversely affect the anti-hot offset properties of toner.

The modified polyester used in the present invention may be prepared by one-shot method or a prepolymer method. The modified polyester generally has a weight average molecular weight of at least 10,000 preferably 20,000 to $10^7$, more preferably 30,000 to $10^6$. Too small a weight average molecular weight of less than 10,000 may adversely affect the anti-hot offset properties of toner. When the modified polyester is used by itself as the binder, the number average molecular weight thereof is generally 20,000 or less, preferably 1000–10,000, more preferably 2,000–8,000. Too large a number average molecular weight above 20,000 may adversely affect low temperature fixation properties of the resulting toner and gloss of color toner images. When the modified polyester is used in conjunction with a non-modified polyester as the toner binder, however, the number average molecular weight thereof is not specifically limited but may be arbitrarily determined in view of the above weight average molecular weight.

It is preferred that the modified polyester be used in conjunction with a non-modified polyester as the toner binder for reasons of low temperature fixation properties of the toner and improved gloss of the toner images. The non-modified polyester may be polycondensation products obtained from polyols and polyacids. Suitable polyols and polyacids are as described previously with reference to the modified polyester. The amount of the non-modified polyester in the toner binder is such that the weight ratio of the modified polyester to the non-modified polyester is generally 5:95 to 80:20, preferably 5:95 to 30:70, more preferably 5:95 to 25:75, most preferably 7:93 to 20:80. Too small an amount of the modified polyester below 5% by weight is disadvantageous because the antihot offset properties are deteriorated and because it is difficult to attain both heat resistive preservability and low temperature fixation properties simultaneously.

It is preferred that the non-modified polyester be compatible with the modified polyester for reasons of low fixation properties and anti-hot offset properties of the toner. Thus, the monomer units (polyol unit and polyacid unit) constituting the non-modified polyester preferably have structures similar to those of the modified polyester.

The toner binder used in the present invention generally has a such a molecular weight distribution according to gel permeation chromatography GPC (calibrated by polystyrene standards) providing a main peak in a molecular weight region of 1,000 to 30,000, preferably 1,500 to 10,000, more preferably 2,000–8,000. When the peak is at less than 1,000, the heat resistive preservability of the toner is apt to be deteriorated, while a peak molecular weight of over 30,000 may adversely affect the low temperature fixation properties of the toner.

The toner binder generally has a hydroxyl value of at least 5, preferably 10–120, more preferably 20–80. Too low a hydroxyl value of less than 5 is disadvantageous to simultaneously attain both good heat resistive preservability and low temperature fixation properties of the toner. The toner binder generally has an acid value of 1–30, preferably 5–20 mg KOH for reasons of improved compatibility between the toner and paper and improved fixing efficiency.

The toner binder used in the present invention generally has a glass transition point of 40–70° C., preferably 50–65° C. A glass transition point of less than 40° C. tends to cause deterioration of heat resistive preservability, while too high a glass transition point of over 70° C. tends to cause deterioration of low temperature fixation properties. Because of the presence of the modified polyester, the dry toner of the present invention exhibits superior heat resistance and preservability even thought the glass transition point of the toner is low.

As the colorant usable for the electrostatic image developing toner of the present invention, any colorant known to be used conventionally for the preparation of a toner can be employed. Suitable colorants for use in the toner of the present invention include known pigments and dyes. These pigments and dyes can be used alone or in combination.

Specific examples of such dyes and pigments include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow NCG)-, Vulcan Fast Yellow (5G and R), Tartrazine Yellow Lake, Quinoline Yellow Lake, Anthracene Yellow BGL, isoindolinone yellow, red iron oxide, red lead, orange lead, cadmium red, cadmium mercury red, antimony orange, Permanet Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX Permanent F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and the like. These dyes and pigments are employed alone or in combination. The content of a coloring agent in the toner of the present invention is preferably from about 1–15% by weight, more preferably 3–10% by weight, based on the weight of the toner.

In one embodiment of the production of toner, the colorant is composited with a resin binder to form a master batch.

As the binder resin for forming the master batch, the above-described modified polyester, non-modified polyester may be used. Further, various other polymers may also be used for the formation of the master batch. Specific examples of such other polymers for use in the formation of the master batch include homopolymers of styrene or substituted styrenes such as polystyrene, polychlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylethyl ether copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer; and polymethyl methacrylate, polybutyl methacrylate, polyvinyl chloride, polyvinyl acetate, polyethylene, polypropylene, polyester, polyvinylbutyl butyral, polyacrylic resin, rosin, modified rosin, terpene resin, phenolic resin, aliphatic hydrocarbon resin, alicyclic hydrocarbon resin, aromatic petroleum resin, chlorinated paraffin, and paraffin wax. These polymers can be used alone or in combination.

The master batch may be obtained by mixing and kneading the binder resin and the colorant while applying a large shear strength thereto using a suitable kneader such as a three-roller mill. In this case, an organic solvent may be used to enhance the interaction between the resin and the colorant. If desired, "flushing" method may be adopted to obtain the master batch. In this method, an aqueous paste containing a colorant is mixed and kneaded together with a binder resin and an organic solvent so that the colorant migrates to the organic phase. The organic solvent and water are then removed.

The toner of the present invention may contain a charge controlling agent, if desired. Any charge controlling agent generally used in the field of toners for use in electrophotography may be used for the purpose of the present invention. Examples of such charge controlling agents include a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing activator material, and metallic salts of salicylic acid and derivatives thereof.

Specific examples of the charge controlling agents include Bontron 03 (Nigrosine dyes), Bontron P-51 (Quaternary ammonium salts), Bontron S-34 (metal-containing azo dyes), E-82 (oxynaphthoic acid type metal complex), E-84 (salicylic acid type metal complex) and E-89 (phenol type condensation products), which are manufactured by Orient Chemical Industries Co., Ltd.; TP-302 and TP-415 (quaternary ammonium salts molybdenum complex), which are manufactured by Hodogaya Chemical Co., Ltd.; Copy Charge PSY VP2038 (quaternary ammonium salts) Copy Blue PR (triphenylmethane derivatives), Copy Charge NEG VP2036 (quaternary ammonium salts) and Copy Charge NX VP434(quaternary ammonium salts), which are manufactured by Hoechst AG; LRA-901 and LR-147 (boron complex), which are manufactured by Japan Carlit Co.; copper Phthalocyanine; perylene; quinacridone; azo type pigments; and polymer compounds having a functional group such as a sulfonic acid group, a carboxyl group or a quaternary ammonium salt group.

The amount of charge control agent for use in the color toner may be determined in light of the kind of binder resin to be employed, the presence or absence of additives, and the preparation method of the toner including the method of dispersing the composition of the toner. It is preferable that the amount of charge control agent be in the range of 0.1 to 10 parts by weight, and more preferably in the range of 2 to 5 parts by weight, per 100 parts by weight of the binder resin. By the addition of the charge control agent in such an amount, sufficient chargeability for use in practice can be imparted to the toner. Further, electrostatic attraction of the toner to a developing roller can be prevented, so that the decrease of fluidity of the developer and the decrease of image density can be prevented.

The charge controlling agent and wax may be mixed and kneaded with the binder resin or the above master batch.

Inorganic fine particles may be suitably used, as an external additive, to improve the fluidity, developing efficiency and chargeability of the toner by being attached to outer surfaces of the toner particles. Such inorganic fine particles include silica, alumina, titanium oxide, barium titanate, magnesium titanate, calcium titanate, strontium titanate, zinc oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle diameter of 5 mμ (5 nm) to 2 μm, more preferably 5 mμ to 500 mμ, and a BET specific surface area of 20–500 $m^2/g$. The inorganic fine particles are used in an amount of generally 0.01–5% by weight, preferably 0.01–2% by weight, based on the weight of the toner.

The external additive (fluidizing agent) may also be fine particles of a polymeric substance such as polystyrene, polymethacrylate or an acrylate copolymer obtained by soap-free emulsion polymerization, suspension polymerization or dispersion polymerization; silicone, benzoguanamine or nylon obtained by polycondensation; or a thermosetting resin.

By subjecting these fluidizing agents to a surface treatment to improve the hydrophobic properties thereof, deterioration of the fluidity and the charge properties of the toner can be avoided even under high humidity conditions. Suitable surface treating agents include silane coupling agents, silane coupling agents having a fluorinated alkyl group, organic titanate type coupling agents, aluminum type coupling agents, silicone oil and modified silicone oil.

Cleaning property improving agents may be also used in the toner of the present invention for facilitating the removal of toner remaining on a photoconductor or an intermediate transfer medium after the transference. Examples of such cleaning property improving agents include fatty acids and their metal salts such as stearic acid, zinc stearate and calcium stearate, and particulate polymers such as polymethyl methacrylate particles and polystyrene particles which are manufactured, for example, by the soap-free emulsion polymerization method. The particulate polymer preferably has a volume average particle diameter of 0.01–1 μm.

Dry toner according to the present invention may be prepared as follows.

First, ingredients of the toner such as a binder including a modified polyester resin, a coloring agent, wax and a charge controlling agent are mechanically mixed with each other using a mixer such as a rotary blade mixer to obtain a mixture.

The mixture is then kneaded using a suitable kneader. A single axis type (or single cylinder type) kneader, a two axis type (or two cylinder type) continuous extruder or a roll mill may be suitably used as the kneader. The kneading should be performed at a temperature near the softening point of the binder resin so as not to cause breakage of the molecular chain of the binder resin. Too high a temperature above the softening point will cause breakage of the molecular chain of the binder resin. The dispersion of the coloring agent, etc. in the binder resin will not sufficiently proceed when the temperature is excessively lower than the softening point.

The kneaded mixture is then solidified and the solidified mixture is grounded, preferably in two, coarsely grinding and succeeding finely grinding stages. The earlier stage may be carried out by impinging the solidified mixture to an impact plate under a jet stream, while the later stage may be performed using a combination of a rotor and a stator with a small gap. The ground mixture is classified in a jet flow utilizing tangential force to obtain a toner having an average size of, for example, 5–20 μm.

The thus obtained toner is, if desired, mixed with an external additive such as a fluidizing agent to improve the fluidity, preservability, developing efficiency and transfer efficiency. The mixing with the external additive may be carried out using a conventional mixer preferably capable of controlling the mixing temperature. The external additive may be added gradually or at once. The rotational speed, mixing time and mixing temperature may be varied in any suitable manner. Illustrative of suitable mixers are V-type mixers, rocking mixers, Ledige mixers, nauter mixers and Henschel mixers.

As methods to obtain spherical toner, there may be mentioned a mechanical method in which ingredients of the toner such as a binder and a colorant are melt-kneaded, solidified, ground and further processed with a hybridizer or a mechanofusion; a spray dry method in which ingredients of the toner are dispersed in a solution of a toner binder dissolved in a solvent, the dispersion being subsequently spray dried; and a dispersion method in which an organic solvent solution or dispersion containing ingredients of the toner such as a binder resin and wax is dispersed in an aqueous medium with stirring, preferably while applying shear forces to the wax, to form toner particles which are subsequently separated and dried.

When the dispersion method is adopted, the polar portions of the modified polyester which are compatible with the aqueous medium selectively gather on surfaces of the toner, so that the wax particles are prevented from exposing on the surfaces of the toner. In the thus obtained toner, the wax particles have are finely divided and dispersed in a inside region of the toner, so that toner filming can be prevented and the toner occur can be charged in a stable manner.

The aqueous medium used in the dispersion method may be water by itself or a mixture of water with a water-miscible solvent such as an alcohol, e.g. methanol, isopropanol or ethylene glycol; dimethylformamide; tetrahydrofuran; cellosolve, e.g. methyl cellosolve; or a lower ketone, e.g. acetone or methyl ethyl ketone.

The modified polyester used in the dispersion method may be a prepolymer thereof. The prepolymer may be converted into the modified polyester during the dispersing step in the aqueous medium by reaction with, for example, a chain extender or a crosslinking agent. For example, a urea-modified polyester may be produced during the dispersing step in the aqueous medium by reaction of an isocyanate-containing polyester prepolymer with an amine. The reaction may be performed at a temperature of 0–150° C. (under a pressurized condition), preferably 40–98° C., for 10 minutes to 40 hours, preferably 2–24 hours in the presence of, if desired, a catalyst such as dibutyltin laurate or dioctyltin laurate.

It is preferred that other ingredients, such as a colorant, a colorant master batch, a wax, a charge controlling agent and a non-modified polyester, than the modified polyester be previously mixed with the modified polyester (or a prepolymer thereof) in an organic solvent. However, at least one of such ingredients may be added to the aqueous medium at the time of dispersing the organic solvent solution of the modified polyester (or a prepolymer thereof) into the aqueous medium or after the formation of toner particles dispersed in the aqueous medium, if desired. For example, the colorant may be incorporated into the toner after the toner particles containing the wax, the binder, etc.

In one preferred embodiment, the wax is dispersed in the organic solvent solution containing the modified polyester (or a prepolymer thereof) by stirring the wax and the modified polyester in an organic solvent in a stirring tank. The resulting mixture is then ground with an atriter, a ball mill, a sand mill or a vibration mill using a granular medium such as granules of stainless steel, carbon steel, alumina, zirconia or silica. In this case, the colorant may be suitably dispersed together with the wax. Thus, the colorant is disaggregated in the stirring tank and dispersed in the mill into an average particle diameter of 0.7 $\mu$m or less, preferably 0.4 $\mu$m or less. A color toner obtained by the above method gives images of excellent gloss and transparency with good reproducibility.

As the organic solvents, there may be mentioned aromatic hydrocarbons such as toluene, xylene and benzene; halogenated hydrocarbons such as carbon tetrachloride, methylene chloride, 1,2-dichloroethane, 1,1,2-trichloroethane, trichloroethylene, chloroform, monochlorobenzene and dichlorloethylidene; esters such as methyl acetate and ethyl acetate; and ketones such as methyl ethyl ketone and methyl isobutyl ketone. These solvents may be used singly or in combination. The amount of the organic solvent is generally 5–300 parts by weight, preferably 10–100 parts by weight, more preferably 25–70 parts by weight, per 100 parts by weight of the modified polyester (or a prepolymer thereof). The use of the solvent can produce toner particles having a narrow particle size distribution.

Dispersion into the aqueous phase may be carried out using any desired dispersing device, such as a low speed shearing type dispersing device, a high speed shearing type dispersing device, an abrasion type dispersing device, a high pressure jet type dispersing device or an ultrasonic-type dispersing device. A high speed shearing type dispersing device is preferably used for reasons of obtaining dispersed toner particles having a diameter of 2–20 $\mu$m in a facilitated manner. The high speed shearing type dispersing device is generally operated at a revolution speed of 1,000–30,000 rpm, preferably 5,000–20,000 rpm. The dispersing time is generally 0.1 to 5 minutes in the case of a batch type dispersing device. The dispersing step is generally performed at 0–150° C. (under a pressurized condition), preferably 40–98° C. A higher temperature is suitably used to decrease the viscosity of the mass.

The aqueous medium is generally used in an amount of 50–2,000 parts by weight, preferably 100–1,000 parts by weight per 100 parts by weight of the toner composition containing the modified polyester (or a prepolymer thereof) and other ingredients for reasons of obtaining suitable dispersion state.

A dispersing agent may be used in dispersing the toner composition into the aqueous medium to stabilize the dispersion and to obtain sharp particle size distribution. Examples of the dispersing agent include anionic surface active agents such as a salt of alkylbenzensulfonic acid, a salt of $\alpha$-olefinsulfonic acid and a phosphoric ester; cationic surface active agents such as amine surfactants (e.g. an alkylamine salt, an aminoalcohol fatty acid derivative, a polyamine fatty acid derivative and imidazoline), and quaternary ammonium salt surfactants (alkyl trimethylammonium salt, dialkyl dimethylammonium salt, alkyl dimethylammonium salt, pyridium salt, alkyl isoquinolinium salt and benzethonium chloride; nonthe modified polyester (or a prepolymer thereof) the modified polyester (or a prepolymer thereof); nonionic surface active agent such as a fatty amide derivative and polyhydric alcohol derivative; and ampholytic surface active agents such as alanine, dodecyl di(aminoethyl)glycine and di(octylaminoethyl)glycine and N-alkyl-N,N-dimethylammoniumbetaine.

A surfactant having a fluoroalkyl group can exert its effects in an only very small amount and is preferably used.

Suitable anionic surfactants having a fluoroalkyl group include fluoroalkylcarboxylic acids having from 2–10 carbon atoms and their metal salts, perfluorooctanesulfonylglutamic acid disodium salt, 3-[omega-fluoroalkyl($C_6$–$C_{11}$)oxy]-1-alkyl ($C_3$–$C_4$) sulfonic acid sodium salts, 3-[omega-fluoroalkanoyl($C_6$–$C_8$)-N-ethylamino]-1-propanesulfonic acid sodium salts, fluoroalkyl($C_{11}$–$C_{20}$)carboxylic acids and their metal salts, perfluoroalkylcarboxylic acids ($C_7$–$C_{13}$) and their metal salts, perfluoroalkyl($C_4$–$C_{12}$)sulfonic acid and their metal salts, perfluorooctanesulfonic acid diethanolamide, N-propyl-N-(2-hydroxyethyl) perfluorooctanesulfonamide, perfluoroalkyl($C_6$–$C_{10}$) sulfoneamidopropyl trimethylammonium salts, perfluoroalkyl ($C_6$–$C_{10}$)-N-ethylsulfonylglycine salts, and monoperfluoroalkyl($C_6$–$C_{16}$)ethylphosphoric acid esters.

Examples of tradenames of anionic surfactants having a perfluoroalkyl group include Surflon S-111, S-112 and S-113 (manufactured by Asahi Glass Co., Ltd.), Florard FC-93, Ec95, FC-98 and FC-129 (manufactured by Sumitomo 3M Ltd.), Unidine DS-101 and DS-102 (manufactured by Daikin Co., Ltd.), Megafac F-110, F-120, F-113, F-191, F-812 and F-833 (manufactured by Dainippon Ink and Chemicals, Inc.), Ektop EF-102, 103, 104, 105, 112, 123A, 123B, 306A, 501, 201 and 204 (manufactured by Tochem Products Co., Ltd.), and Phthargent F-100 and F-150 (manufactured by Neos co., Ltd.).

Examples of suitable cationic surfactants having a fluoroalkyl group include primary, secondary or tertiary aliphatic amine salts; aliphatic quaternary ammonium salts such as perfluoroalkyl($C_6$–$C_{10}$) sulfonamidopropyltrimethyl-ammonium salts; benzalkonium salts; benzethonium chloride; pyridinium salts; and imidazolinium salts. Tradenamed cationic surfactants include Surflon S-121 (Asahi Glass Co., Ltd.), Florard FC-135 (manufactured by Sumitomo 3M Ltd.), Unidine DS-202 (manufactured by Daikin Co.), Megafac F-150 and F-824 (Dainippon Ink and Chemicals Inc.), Ektop EF-132 (manufactured by Tochem Products Co., Ltd.), and Phthargent F-300 (manufactured by Neos Co., Ltd.).

In addition, dispersants of inorganic compounds, which are hardly soluble in water, such as tricalcium phosphate, calcium carbonate, titanium oxide, colloidal silica, and hydroxyapatite can also be employed.

In addition, primary particles can be stabilized with polymer type protective colloids. Specific examples of such polymer type protective colloids include homopolymers and copolymers of the following compounds: acids such as acrylic acid, methacrylic acid, α-cyanoacrylic acid, α-cyanomethacrylic acid, itaconic acid, crotonic acid, fumaric acid, maleic acid, and maleic anhydride;

(meth)acrylic monomers such as .beta.-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylol acrylamide, and N-methylol methacrylamide;

vinyl alcohol, ethers such as vinyl methyl ether, vinyl ethyl ether and vinyl propyl ether, esters of vinyl alcohol with a carboxylic acid such as vinylacetate, vinylpropionate and vinyl butyrate;

amides such as acrylamide, methacrylamide, diacetoneacrylamide, and their methylol compounds;

acid chloride compounds such as acrylic acid chloride, and methacrylic acid chloride;

homopolymers and copolymers of compounds having a nitrogen atom or a heterocyclic ring including a nitrogen atom such as vinyl pyridine, vinyl pyrrolidone, vinyl imidazole and ethylene imine;

polyoxyethylene compounds such as polyoxyethylene, polyoxypropylene, polyoxyethylenealkylamine, polyoxypropylenealkylamine, polyoxyethylenealkylamide, polyoxypropylenealkylamide, polyoxyethylenenonylphenylether, polyoxyethylenelaurylphenylether, polyoxyethylenestearylphenylether, and polyoxyethylenenonylphenylether; and cellulose compounds such as methyl cellulose, hydroxyethyl cellulose, and hydroxypropyl cellulose.

The resulting dispersion or emulsion of toner particles in the aqueous medium is then treated to remove the organic solvent. The removal of the organic solvent can be carried out by gradually heating the dispersion to evaporate the organic solvent and also water to dryness. Alternatively, the dispersion is sprayed into a dry atmosphere to evaporate the organic solvent to obtain fine toner particles which are then dried to remove water. The dry atmosphere may be a gas, such as air, nitrogen, carbon dioxide, combustion gas, which is heated above the boiling point of the organic solvent used. A spray drier, a belt drier or a rotary kiln may be used for separating and drying the toner particles.

When a dispersing agent capable of being dissolved in an acid or an alkali is used, washing with an acid or alkali and then with water can remove the dispersing agent from the toner particles. For example, calcium phosphate may be removed by washing with an acid and then with water. An enzyme may be also used to remove certain kinds of the dispersing agent. Although the dispersing agent can be retained on the toner particles, the removal thereof is preferable for reasons of charging characteristics of the toner.

When the toner particles in the dispersion obtained have a wide particle size distribution, classification may be conducted. The classification for the removal of excessively fine particles is preferably carried out before separation of the toner particles from the dispersion for reasons of efficiency, though the classification may be preceded by the separation and drying of the particles. Classification for the removal of fine particles may be performed using, for example, a cyclone, a decanter or a centrifugal device. Air classification may be suitably adopted for the removal of large particles after drying of the toner particles. Large and small particles thus separated may be reused as raw materials for the preparation of the toner.

The thus obtained toner particles can be mixed with different types of particles such as a particulate release agent, a particulate charge controlling agent, a particulate fluidizing agent and a particulate colorant. By applying mechanical force to the mixture, these different particles can be fixed and unified with the surface of the toner particles and thereby the different particles are prevented from releasing from the resultant complex particles. Methods useful for applying mechanical force include impacting the mixture rapidly-rotating blades; and discharging the mixture into a high speed airflow so that the particles of the mixture accelerate and collide with each other or the particles impact against a proper plate or some such object. Specific examples of such apparatuses include an Ong Mill (manufactured by Hosokawa Micron Co., Ltd.), modified I type Mill in which pressure of air for pulverization is reduced (manufactured by Nippon Pneumatic Co., Ltd.), Hybridization System (manufactured by Nara Machine Co., Ltd.), Kryptron System (manufactured by Kawasaki Heavy Industries, Ltd.), and automatic mortars.

The toner according to the present invention preferably has a volume average particle size of 3 to 10 μm for reasons of obtaining high grade images and good transferability and cleaning efficiency.

The toner according to the present invention can be used as a two-component developer after mixed with a carrier or as a one-component developer or microtoning developer having magnetic powders incorporated in the toner. When the toner of the present invention is employed as a two-component developer, any conventionally-known carrier can be used. Examples include magnetic powders such as iron powders, ferrite powders, magnetite powders, magnetic resin powders and nickel powders and glass beads, and these powders having a surface treated with a resin. Examples of the resin for covering the surface of the carrier include amino resins, urea-formaldehyde resins, melamine resins, benzoguanamine resins, urea resins, polyamide resins and epoxy resins. Also usable for covering carrier are polyvinyl or polyvinylidene resins; polystyrene-type resins such as acrylic resins, polymethyl methacrylate resins, polyacrylonitrile resins, polyvinyl acetate resins, polyvinyl fluoride resins; polyvinyl butyral resins, polyvinyl alcohol resins, polystyrene resins and styrene-acrylic acid copolymers; halogenated olefin resins such as polyvinyl chloride resins; polyester resins such as polyethylene terephthalate resins and polybutylene terephthalate resins; polycarbonate resins; polyethylene resins; polyvinylidene fluoride resins; polytrifluoroethylene resins; polyhesafluoropropylene resins; copolymers of vinylidene fluoride and acrylic monomer; copolymers of vinylidene fluoride and vinyl fluoride; terpolymers of tetrafluoroethylene, vinylidene fluoride and a fluorine-free monomer; and silicone resins.

The resin coating for the carrier may contain conductive powder such as metal powder, carbon black, titanium oxide, tin oxide or zinc oxide. The conductive powder preferably has an average particle diameter of 1 $\mu$m or less for reasons of easy control of the electric resistance.

The following examples will further illustrate the present invention. Parts are by weight.

EXAMPLE 1

Preparation of Toner Binder (1):

In a reactor equipped with a condenser, a stirrer and a nitrogen feed pipe, 724 parts of an ethylene oxide (2 mol) adduct of bisphenol A, 276 parts of isophthalic acid and 2 parts of dibutyltin oxide were charged. The mixture was reacted at 230° C. under ambient pressure for 8 hours. The reaction was further continued for 5 hours at a reduced pressure of 10–15 mmHg. The contents in the reactor was then cooled to 160° C., to which 32 parts of phthalic anhydride were added. The resulting mixture was reacted for 2 hours. The polyester-containing mixture thus obtained was cooled to 80° C. and was reacted with 188 parts of isophorone diisocyanate for 2 hours to obtain an isocyanate-containing polyester prepolymer (Prepolymer (1)).

The prepolymer (1) (267 parts) was then reacted with isophoronediamine (14 parts) at 50° C. for 2 hours to obtain a urea-modified polyester (Urea-Modified Polyester (1)) having a weight average molecular weight of 64,000.

In the same manner as described above, an ethylene oxide (2 mol) adduct of bisphenol A (724 parts) was reacted with isophthalic acid (276 parts) at 230° C. under ambient pressure for 8 hours. The reaction was further continued for 5 hours at a reduced pressure of 10–15 mmHg to obtain a non-modified polyester (Non-Modified Polyester (a)) having such a molecular weight distribution according to gel permeation chromatography as to provide a main peak at a molecular weight of 5,000.

The above Urea-Modified Polyester (1) (100 parts) and 900 parts of the Non-Modified Polyester (a) were dissolved in 2000 parts of a 1:1 (by weight) mixed solvent of ethyl acetate and methyl ethyl ketone. The solution was then dried in vacuo to obtain a toner binder (Toner Binder (1)) having a glass transition point (Tg) of 62° C., an acid value of 10 mg KOH and such a molecular weight distribution according to gel permeation chromatography that the main peak was at a molecular weight of 5,000 and that that portion of Toner Binder (1) having a molecular weight of 30,000 or more accounted for 5% by weight of Toner Binder (1).

Preparation of Toner (I):

In a vessel equipped with a stirrer and a thermometer, 371 parts of Toner Binder (1) obtained above, 108 parts of carnauba wax (molecular weight: 2000, acid value: 3, melting point: 84° C.), 22 parts of a charge controlling agent (zinc complex of salicylic acid; E-84 manufactured by Orient Kagaku Kogyo K.K.) and 930 parts of ethyl acetate were charged and heated with stirring to 80° C. and maintained at that temperature for 5 hours with stirring. The contents in the vessel were then cooled to 30° C. through 1 hour, to which 250 parts of copper phthalocyanine blue and 500 parts of ethyl acetate were mixed. The mixture was stirred for 1 hour. 1430 Parts of this mixture were dispersed using a beads mill (Ultra Visco Mill manufactured by Imex Co., Ltd) at a feed rate of 1 kg/hour and a disc peripheral speed of 6 m/second. Zirconia beads having a diameter of 0.5 mm were used in an amount of 80% by volume. The dispersing treatment was repeated by passing the mixture three times through the mill. The resulting mixture was further blended with 1430 parts of a 65% ethyl acetate solution of the above Toner Binder (1). The blend was dispersed using the above beads mill under the same conditions except that the blend was passed through the mill only once, thereby obtaining a dispersion (Dispersion (1)).

In a beaker, 706 parts of ion-exchanged water, 294 parts of a 10% hydroxyapatite emulsion (Supertite 10 manufactured by Nippon Kagaku Kogyo Co., Ltd.) and 0.2 parts of sodium dodecylbenzene sulfonate were placed and heated to 60° C. While stirring the solution with TK-type homomixer at rotation speed of 12,000 rpm, the above Dispersion (1) was added to the beaker. The stirring of the mixture was continued for 10 minutes. The resulting dispersion was placed in a flask equipped with a stirrer and a thermometer and heated to 98° C. to remove the solvent. This was then filtered, washed, dried and air-classified to obtain toner particles having a volume average particle diameter of 5 $\mu$m. The toner particles (100 parts) were mixed with 0.5 part of hydrophobic silica and 0.5 part of hydrophobic titanium oxide using Henschel mixer to obtain a toner (Toner (I)) according to the present invention. That portion of the wax particles contained in Toner (I) and having a dispersion diameter of 0.1–3 $\mu$m was found to account for 90% by number of the wax particles.

EXAMPLE 2

Preparation of Toner (II):

Example 1 was repeated in the same manner as described except that the amount of the ethyl acetate used in the dispersing treatment was decreased from 930 parts to 751 parts, thereby obtaining Toner (II) having a greater content of wax particles having a large dispersion diameter as compared with that in Toner (I) according to the present invention. That portion of the wax particles contained in Toner (II) and having a dispersion diameter of 0.1–3 $\mu$m was found to account for 70% by number of the wax particles.

EXAMPLE 3

Preparation of Toner (III):

Example 1 was repeated in the same manner as described except that the number of repetition of the passage through the mill in the dispersing treatment was increased from 3 to 5, thereby obtaining Toner (III) according to the present invention having a greater content of wax particles having a small dispersion diameter as compared with that in Toner (I). That portion of the wax particles contained in Toner (III) and having a dispersion diameter of 0.1–3 $\mu$m was found to account for 85% by number of the wax particles.

EXAMPLE 4

Preparation of Toner (IV):

Example 1 was repeated in the same manner as described except that paraffin wax (molecular weight: 400, acid value:

0.5, melting point: 78° C.) was substituted for the carnauba wax thereby obtaining Toner (IV) according to the present invention. That portion of the wax particles contained in Toner (IV) and having a dispersion diameter of 0.1–3 μm was found to account for 78% by number of the wax particles.

EXAMPLE 5

Preparation of Toner Binder (5):

An ethylene oxide (2 mol) adduct of bisphenol A (924 parts) was reacted with terephthalic acid (276 parts) at 230° C. under ambient pressure for 8 hours. The reaction was further continued for 5 hours at a reduced pressure of 10–15 mmHg to obtain a non-modified polyester (Non-Modified Polyester (b)) having such a molecular weight distribution according to gel permeation chromatography as to provide a main peak at a molecular weight of 5,000. The above Urea-Modified Polyester (1) (100 parts) and 900 parts of the Non-Modified Polyester (b) were dissolved in 2000 parts of a 1:1 (by weight) mixed solvent of ethyl acetate and methyl ethyl ketone. The solution was then dried in vacuo to obtain a toner binder (Toner Binder (5)) having a glass transition point (Tg) of 62° C., an acid value of 0.5 mg KOH and such a molecular weight distribution according to gel permeation chromatography that the main peak was at a molecular weight of 5,000 and that that portion of Toner Binder (5) having a molecular weight of 30,000 or more accounted for 5% by weight of Toner Binder (5).

Preparation of Toner (V):

The procedure of Preparation of Toner (I) in Example 1 was repeated in the same manner as described except that Toner binder (5) was substituted for Toner Binder (1), thereby obtaining Toner (V) according to the present invention having a volume average particle diameter of 5 μm. That portion of the wax particles contained in Toner (V) and having a dispersion diameter of 0.1–3 μm was found to account for 80% by number of the wax particles.

EXAMPLE 6

Preparation of Toner Binder (6):

An ethylene oxide (2 mol) adduct of bisphenol A (824 parts) was reacted with terephthalic acid (276 parts) at 230° C. under ambient pressure for 8 hours. The reaction was further continued for 5 hours at a reduced pressure of 10–15 mmHg to obtain a non-modified polyester (Non-Modified Polyester (c)) having such a molecular weight distribution according to gel permeation chromatography as to provide a main peak at a molecular weight of 5,000. The above Urea-Modified Polyester (1) (100 parts) and 900 parts of the Non-Modified Polyester (c) were dissolved in 2000 parts of a 1:1 (by weight) mixed solvent of ethyl acetate and methyl ethyl ketone. The solution was then dried in vacuo to obtain a toner binder (Toner Binder (6)) having a glass transition point (Tg) of 62° C., an acid value of 2 mg KOH and such a molecular weight distribution according to gel permeation chromatography that the main peak was at a molecular weight of 5,000 and that that portion of Toner Binder (6) having a molecular weight of 30,000 or more accounted for 5% by weight of Toner Binder (6).

Preparation of Toner (VI):

The procedure of Preparation of Toner (I) in Example 1 was repeated in the same manner as described except that Toner binder (6) was substituted for Toner Binder (1), thereby obtaining Toner (VI) according to the present invention having a volume average particle diameter of 5 μm. That portion of the wax particles contained in Toner (V) and having a dispersion diameter of 0.1–3 μm was found to account for 83% by number of the wax particles.

EXAMPLE 7

Preparation of Toner Binder (7):

An ethylene oxide (2 mol) adduct of bisphenol A (724 parts) was reacted with terephthalic acid (276 parts) at 230° C. under ambient pressure for 8 hours. The reaction was further continued for 5 hours at a reduced pressure of 10–15 mmHg. The reaction mixture was then cooled to 160° C., to which 32 parts of trimellitic anhydride were added. The resulting mixture was reacted for 2 hours to obtain a non-modified polyester (Non-Modified Polyester (d)) having such a molecular weight distribution according to gel permeation chromatography as to provide a main peak at a molecular weight of 5,000.

The above Urea-Modified Polyester (1) (100 parts) and 900 parts of the Non-Modified Polyester (d) were dissolved in 2000 parts of a 1:1 (by weight) mixed solvent of ethyl acetate and methyl ethyl ketone. The solution was then dried in vacuo to obtain a toner binder (Toner Binder (7)) having a glass transition point (Tg) of 62° C., an acid value of 25 mg KOH and such a molecular weight distribution according to gel permeation chromatography that the main peak was at a molecular weight of 5,000 and that that portion of Toner Binder (7) having a molecular weight of 30,000 or more accounted for 5% by weight of Toner Binder (7).

Preparation of Toner (VII):

The procedure of Preparation of Toner (I) in Example 1 was repeated in the same manner as described except that Toner binder (7) was substituted for Toner Binder (1), thereby obtaining Toner (VII) according to the present invention having a volume average particle diameter of 5 μm. That portion of the wax particles contained in Toner (VII) and having a dispersion diameter of 0.1–3 μm was found to account for 86% by number of the wax particles.

EXAMPLE 8

Preparation of Toner Binder (8):

An ethylene oxide (2 mol) adduct of bisphenol A (724 parts) was reacted with terephthalic acid (276 parts) at 230° C. under ambient pressure for 8 hours. The reaction was further continued for 5 hours at a reduced pressure of 10–15 mmHg. The reaction mixture was then cooled to 160° C., to which 48 parts of trimellitic anhydride were added. The resulting mixture was reacted for 2 hours to obtain a non-modified polyester (Non-Modified Polyester (e)) having such a molecular weight distribution according to gel permeation chromatography as to provide a main peak at a molecular weight of 5,000.

The above Urea-Modified Polyester (1) (100 parts) and 900 parts of the Non-Modified Polyester (e) were dissolved in 2000 parts of a 1:1 (by weight) mixed solvent of ethyl acetate and methyl ethyl ketone. The solution was then dried in vacuo to obtain a toner binder (Toner Binder (8)) having a glass transition point (Tg) of 62° C., an acid value of 35 mg KOH and such a molecular weight distribution according to gel permeation chromatography that the main peak was at a molecular weight of 5,000 and that that portion of Toner Binder (8) having a molecular weight of 30,000 or more accounted for 5% by weight of Toner Binder (8).

Preparation of Toner (VIII):

The procedure of Preparation of Toner (I) in Example 1 was repeated in the same manner as described except that Toner binder (8) was substituted for Toner Binder (1), thereby obtaining Toner (VIII) according to the present invention having a volume average particle diameter of 5 μm. That portion of the wax particles contained in Toner (VIII) and having a dispersion diameter of 0.1–3 μm was found to account for 89% by number of the wax particles.

EXAMPLE 9

Preparation of Toner Binder (9):

An ethylene oxide (2 mol) adduct of bisphenol A (724 parts) was reacted with terephthalic acid (276 parts) at 230° C. under ambient pressure for 2 hours. The reaction was further continued for 5 hours at a reduced pressure of 10–15 mmHg to obtain a non-modified polyester (Non-Modified Polyester (f)) having such a molecular weight distribution according to gel permeation chromatography as to provide a main peak at a molecular weight of 1,000.

The above Urea-Modified Polyester (1) (100 parts) and 900 parts of the Non-Modified Polyester (f) were dissolved in 2000 parts of a 1:1 (by weight) mixed solvent of ethyl acetate and methyl ethyl ketone. The solution was then dried in vacuo to obtain a toner binder (Toner Binder (9)) having a glass transition point (Tg) of 45° C., an acid value of 10 mg KOH and such a molecular weight distribution according to gel permeation chromatography that the main peak was at a molecular weight of 1,000 and that that portion of Toner Binder (9) having a molecular weight of 30,000 or more accounted for 4% by weight of Toner Binder (9).

Preparation of Toner (IX):

The procedure of Preparation of Toner (I) in Example 1 was repeated in the same manner as described except that Toner binder (9) was substituted for Toner Binder (1), thereby obtaining Toner (IX) according to the present invention having a volume average particle diameter of 5 μm. That portion of the wax particles contained in Toner (IX) and having a dispersion diameter of 0.1–3 μm was found to account for 73% by number of the wax particles.

EXAMPLE 10

Preparation of Toner Binder (10):

An ethylene oxide (2 mol) adduct of bisphenol A (724 parts) was reacted with terephthalic acid (276 parts) at 230° C. under ambient pressure for 4 hours. The reaction was further continued for 5 hours at a reduced pressure of 10–15 mmHg to obtain a non-modified polyester (Non-Modified Polyester (g)) having such a molecular weight distribution according to gel permeation chromatography as to provide a main peak at a molecular weight of 2,000.

The above Urea-Modified Polyester (1) (100 parts) and 900 parts of the Non-Modified Polyester (g) were dissolved in 2000 parts of a 1:1 (by weight) mixed solvent of ethyl acetate and methyl ethyl ketone. The solution was then dried in vacuo to obtain a toner binder (Toner Binder (10)) having a glass transition point (Tg) of 52° C., an acid value of 10 mg KOH and such a molecular weight distribution according to gel permeation chromatography that the main peak was at a molecular weight of 2,000 and that that portion of Toner Binder (10) having a molecular weight of 30,000 or more accounted for 5% by weight of Toner Binder (10).

Preparation of Toner (X):

The procedure of Preparation of Toner (I) in Example 1 was repeated in the same manner as described except that Toner binder (10) was substituted for Toner Binder (1), thereby obtaining Toner (X) according to the present invention having a volume average particle diameter of 5 μm. That portion of the wax particles contained in Toner (X) and having a dispersion diameter of 0.1–3 μm was found to account for 76% by number of the wax particles.

EXAMPLE 11

Preparation of Toner Binder (11):

An ethylene oxide (2 mol) adduct of bisphenol A (724 parts) was reacted with terephthalic acid (276 parts) at 230° C. under ambient pressure for 10 hours. The reaction was further continued for 5 hours at a reduced pressure of 10–15 mmHg to obtain a non-modified polyester (Non-Modified Polyester (h)) having such a molecular weight distribution according to gel permeation chromatography as to provide a main peak at a molecular weight of 20,000.

The above Urea-Modified Polyester (1) (100 parts) and 900 parts of the Non-Modified Polyester (h) were dissolved in 2000 parts of a 1:1 (by weight) mixed solvent of ethyl acetate and methyl ethyl ketone. The solution was then dried in vacuo to obtain a toner binder (Toner Binder (11)) having a glass transition point (Tg) of 69° C., an acid value of 10 mg KOH and such a molecular weight distribution according to gel permeation chromatography that the main peak was at a molecular weight of 20,000 and that that portion of Toner Binder (11) having a molecular weight of 30,000 or more accounted for 6% by weight of Toner Binder (11).

Preparation of Toner (XI):

The procedure of Preparation of Toner (I) in Example 1 was repeated in the same manner as described except that Toner binder (11) was substituted for Toner Binder (1), thereby obtaining Toner (XI) according to the present invention having a volume average particle diameter of 5 μm. That portion of the wax particles contained in Toner (XI) and having a dispersion diameter of 0.1–3 μm was found to account for 79% by number of the wax particles.

EXAMPLE 12

Preparation of Toner Binder (12):

An ethylene oxide (2 mol) adduct of bisphenol A (724 parts) was reacted with terephthalic acid (276 parts) at 230° C. under ambient pressure for 12 hours. The reaction was further continued for 5 hours at a reduced pressure of 10–15 mmHg to obtain a non-modified polyester (Non-Modified Polyester (i)) having such a molecular weight distribution according to gel permeation chromatography as to provide a main peak at a molecular weight of 30,000.

The above Urea-Modified Polyester (1) (100 parts) and 900 parts of the Non-Modified Polyester (i) were dissolved in 2000 parts of a 1:1 (by weight) mixed solvent of ethyl acetate and methyl ethyl ketone. The solution was then dried in vacuo to obtain a toner binder (Toner Binder (12)) having a glass transition point (Tg) of 73° C., an acid value of 10 mg KOH and such a molecular weight distribution according to gel permeation chromatography that the main peak was at a molecular weight of 30,000 and that that portion of Toner Binder (12) having a molecular weight of 30,000 or more accounted for 7% by weight of Toner Binder (12).

Preparation of Toner (XII):

The procedure of Preparation of Toner (I) in Example 1 was repeated in the same manner as described except that Toner binder (12) was substituted for Toner Binder (1), thereby obtaining Toner (XII) according to the present invention having a volume average particle diameter of 5 μm. That portion of the wax particles contained in Toner (XII) and having a dispersion diameter of 0.1–3 μm was found to account for 81% by number of the wax particles.

EXAMPLE 13

Preparation of Toner (XIII):

Using a Henschel mixer, 100 parts of Toner Binder (1), 8 parts of carbon black and 10 parts of carnauba wax were mixed. The mixture was then kneaded using a continuous-type kneader. The kneaded mixture was solidified and ground using a jet mill and classified using an air classifying device. The resulting particles were rounded using a turbo mill to obtain toner particles having a volume average particle diameter of 6 μm. The toner particles (100 parts) were mixed with 0.5 part of hydrophobic silica and 0.5 part of hydrophobic titanium oxide using Henschel mixer to obtain Toner (XIII) according to the present invention. That portion of the wax particles contained in Toner (XIII) and having a dispersion diameter of 0.1–3 μm was found to account for 72% by number of the wax particles.

EXAMPLE 14

Preparation of Prepolymer (1):

In a reactor equipped with a condenser, a stirrer and a nitrogen feed pipe, 724 parts of an ethylene oxide (2 mol) adduct of bisphenol A, 250 parts of isophthalic acid, 24 parts of terephthalic acid and 2 parts of dibutyltin oxide were charged. The mixture was reacted at 230° C. under ambient pressure for 8 hours. The reaction was further continued for 5 hours at a reduced pressure of 10–15 mmHg. The contents in the reactor was then cooled to 160° C., to which 32 parts of phthalic anhydride were added. The resulting mixture was reacted for 2 hours. The polyester-containing mixture thus obtained was cooled to 80° C. and was reacted with 188 parts of isophorone diisocyanate for 2 hours to obtain an isocyanate-containing polyester prepolymer (Prepolymer (2)).

Preparation of Ketimine (1):

In a reactor equipped with a stirrer and a thermometer, 30 parts of isophoronediamine and 70 parts of methyl ethyl ketone were charged. The mixture was then reacted at 50° C. for 5 hours to obtain a ketimine compound (Ketimine (1)).

The prepolymer (1) (267 parts) was then reacted with isophoronediamine (14 parts) at 50° C. for 2 hours to obtain a urea-modified polyester (Urea-Modified Polyester (1)) having a weight average molecular weight of 64,000.

Preparation of Toner (XIV):

In a vessel equipped with a stirrer and a thermometer, 371 parts of Non-Modified Polyester (a) obtained in Example 1, 108 parts of carnauba wax (molecular weight: 2000, acid value: 3, melting point: 84° C.), 22 parts of a charge controlling agent (zinc complex of salicylic acid; E-84 manufactured by Orient Kagaku Kogyo K.K.) and 930 parts of ethyl acetate were charged and heated with stirring to 80° C. and maintained at that temperature for 5 hours with stirring. The contents in the vessel were then cooled to 30° C. through 1 hour, to which 250 parts of copper phthalocyanine blue and 500 parts of ethyl acetate were mixed. The mixture was stirred for 1 hour. 1430 Parts of this mixture were dispersed using a beads mill (Ultra Visco Mill manufactured by Imex Co., Ltd) at a feed rate of 1 kg/hour and a disc peripheral speed of 6 m/second. Zirconia beads having a diameter of 0.5 mm were used in an amount of 80% by volume. The dispersing treatment was repeated by passing the mixture three times through the mill. The resulting mixture was further blended with 1430 parts of a 65% ethyl acetate solution of Non-Modified Polyester (a) and 209 parts of the above Prepolymer (2). The blend was dispersed using the above beads mill under the same conditions except that the blend was passed through the mill only once to obtain a dispersion. To this dispersion, 37 parts of Ketimine (1) was dissolved, thereby obtaining a dispersion (Dispersion (2)).

In a beaker, 706 parts of ion-exchanged water, 294 parts of a 10% hydroxyapatite emulsion (Supertite 10 manufactured by Nippon Kagaku Kogyo Co., Ltd.) and 0.2 parts of sodium dodecylbenzene sulfonate were placed and heated to 60° C. While stirring the solution with TK-type homomixer at rotation speed of 12,000 rpm, the above Dispersion (2) was added to the beaker. The stirring of the mixture was continued for 10 minutes. The resulting dispersion was placed in a flask equipped with a stirrer and a thermometer and heated to 98° C. to remove the solvent while reacting Prepolymer (2) with Ketimine (1). This was then filtered, washed, dried and air-classified to obtain toner particles having a volume average particle diameter of 5 μm. The toner particles (100 parts) were mixed with 0.5 part of hydrophobic silica and 0.5 part of hydrophobic titanium oxide using Henschel mixer to obtain a toner (Toner (XIV)) according to the present invention. The urea-modified polyester contained in Toner (XIV) had a glass transition point (Tg) of 62° C., an acid value of 10 mg KOH and such a molecular weight distribution according to gel permeation chromatography that the main peak was at a molecular weight of 5,000 and that that portion of the urea-modified polyester having a molecular weight of 30,000 or more accounted for 5% by weight of thereof. That portion of the wax particles contained in Toner (XIV) and having a dispersion diameter of 0.1–3 μm was found to account for 88% by number of the wax particles.

EXAMPLE 15

Preparation of Polystyrene-Grafted Polyester:

In a reactor equipped with a condenser, a stirrer and a nitrogen feed pipe, 724 parts of an ethylene oxide (2 mol) adduct of bisphenol A, 200 parts of isophthalic acid, 70 parts of fumaric acid and 2 parts of dibutyltin oxide were charged. The mixture was reacted at 230° C. under ambient pressure for 8 hours. The reaction was further continued for 5 hours at a reduced pressure of 10–15 mmHg. The contents in the reactor was then cooled to 160° C., to which 32 parts of phthalic anhydride were added. The resulting mixture was reacted for 2 hours. The polyester-containing mixture thus obtained was cooled to 80° C. and mixed with 200 parts of styrene, 1 part of benzoylperoxide and 0.5 part of dimethylaniline. The mixture was reacted for 2 hours. The ethyl acetate was then removed from the reaction mixture by distillation to obtain a modified polyester having polystyrene grafted thereonto (Polystyrene-Grafted Polyester) and having a weight average molecular weight of 92,000.

Preparation of Toner Binder (15):

The above Polystyrene-Grafted Polyester (100 parts) and 900 parts of the Non-Modified Polyester (a) obtained in Example 1 were dissolved in 2000 parts of a 1:1 (by weight) mixed solvent of ethyl acetate and methyl ethyl ketone. The solution was then dried in vacuo to obtain a toner binder (Toner Binder (15)).

Preparation of Toner (XV):

The procedure of Preparation of Toner (I) in Example 1 was repeated in the same manner as described except that Toner binder (15) was substituted for Toner Binder (1), thereby obtaining Toner (XV) according to the present invention having a volume average particle diameter of 5 μm. That portion of the wax particles contained in Toner (XV) and having a dispersion diameter of 0.1–3 μm was found to account for 91% by number of the wax particles.

COMPARATIVE EXAMPLE 1

Preparation of Toner Binder (X):

In a reactor equipped with a condenser, a stirrer and a nitrogen feed pipe, 343 parts of an ethylene oxide (2 mol) adduct of bisphenol A, 166 parts of isophthalic acid and 2 parts of dibutyltin oxide were charged. The mixture was reacted at 230° C. under ambient pressure for 8 hours. The reaction was further continued for 5 hours at a reduced pressure of 10–15 mmHg. The contents in the reactor was then cooled to 80° C. and was reacted with 14 parts of toluenediisocyanate in toluene at 110° C. for 5 hours. The solvent was then removed by distillation to obtain a urethane-modified polyester having a weight average molecular weight of 98,000.

In the same manner as described above, an ethylene oxide (2 mol) adduct of bisphenol A (363 parts) was reacted with isophthalic acid (166 parts) to obtain a non-modified polyester having a hydroxyl value of 25, an acid value of 7 and such a molecular weight distribution according to gel permeation chromatography as to provide a main peak at a molecular weight of 3,800.

The above urethane-modified polyester (350 parts) and 650 parts of the above non-modified polyester were dissolved in toluene and the solution was then dried in vacuo to obtain a toner binder (Toner binder (x)) having a glass transition point (Tg) of 58° C., an acid value of 7 mg KOH and such a molecular weight distribution according to gel permeation chromatography that the main peak was at a molecular weight of 3,800 and that that portion of Toner Binder (x) having a molecular weight of 30,000 or more accounted for 12% by weight of Toner Binder (x).

Preparation of Comparative Toner (I):

Using a Henschel mixer, 100 parts of Toner Binder (x) and 4 parts of copper phthalocyanine blue were mixed. The mixture was then kneaded using a continuous-type kneader. The kneaded mixture was solidified and ground using a jet mill and classified using an air classifying device to obtain toner particles having a volume average particle diameter of 12 μm. The toner particles (100 parts) were mixed with 0.5 part of hydrophobic silica and 0.5 part of hydrophobic titanium oxide using Henschel mixer to obtain Comparative Toner (I) containing no wax particles.

COMPARATIVE EXAMPLE 2

Preparation of Comparative Toner (II):

The procedure of Preparation of Comparative Toner (I) in Comparative Example 1 was repeated in the same manner as described except 10 parts of carnauba wax were also mixed with Toner Binder (x) and copper phthalocyanine blue to obtain toner particles having a volume average particle diameter of 12 μm. The toner particles (100 parts) were mixed with 0.5 part of hydrophobic silica and 0.5 part of hydrophobic titanium oxide using Henschel mixer to obtain Comparative Toner (II). That portion of the wax particles contained in Comparative Toner (II) and having a dispersion diameter of 0.1–3 μm was found to account for 58% by number of the wax particles.

COMPARATIVE EXAMPLE 3

Preparation of Toner Binder (y):

354 Parts of an ethylene oxide (2 mol) adduct of bisphenol A and 166 parts of isophthalic acid were reacted in the presence of 2 parts of dibutyltin oxide to obtain a toner binder (Toner binder (y)) having a weight average molecular weight of 8,000, a glass transition point (Tg) of 57° C. and such a molecular weight distribution according to gel permeation chromatography that the main peak was at a molecular weight of 5,000 and that that portion of Toner Binder (y) having a molecular weight of 30,000 or more accounted for 0.3% by weight of Toner Binder (y).

Preparation of Comparative Toner (III):

Using a TK-type homomixer, 100 parts of Toner Binder (y), 200 parts of ethyl acetate and 4 parts of copper phthalocyanine blue were mixed at a revolution speed of 12,000 to obtain a dispersion. The procedure of Preparation of Toner (I) in Example 1 was repeated in the same manner as described except that the above dispersion was used in lieu of Dispersion (1), thereby to obtain Comparative Toner (III) having a volume average particle diameter of 5 μm and containing no wax particles.

COMPARATIVE EXAMPLE 4

Preparation of Comparative Toner (IV):

In a beaker, 240 parts of a solution of Toner Binder (1) dissolved in a mixed solvent of ethyl acetate and methyl ethyl ketone, 10 parts of carnauba wax (molecular weight: 2000, acid value: 3, melting point: 84° C.) and 1 part of a charge controlling agent (zinc complex of salicylic acid; E-84 manufactured by Orient Kagaku Kogyo K.K.) were charged and mixed at 60° C. with stirring using a TK-type homomixer at a revolution speed of 12,000 rpm to obtain a homogeneous dispersion. In a beaker, 706 parts of ion-exchanged water, 294 parts of a 10% hydroxyapatite emulsion (Supertite 10 manufactured by Nippon Kagaku Kogyo Co., Ltd.) and 0.2 parts of sodium dodecylbenzene sulfonate were placed and heated to 60° C. While stirring the solution with TK-type homomixer at rotation speed of 12,000 rpm, the above dispersion was added to the beaker. The stirring of the mixture was continued for 10 minutes. The resulting dispersion was placed in a flask equipped with a stirrer and a thermometer and heated to 98° C. to remove the solvent. This was then filtered, washed, dried and air-classified to obtain toner particles having a volume average particle diameter of 5 μm. The toner particles (100 parts) were mixed with 0.5 part of hydrophobic silica and 0.5 part of hydrophobic titanium oxide using Henschel mixer to obtain a toner (Comparative Toner (IV)). That portion of the wax particles contained in Toner (I) and having a dispersion diameter of 0.1–3 μm was found to account for 60% by number of the wax particles.

In the present specification, the particle diameter of toner particles, melting point of wax and glass transition point (Tg) are measured as follows:

Measurement of Particle Diameter:

The particle diameter distribution of the toner is measured with a Coulter counter (Model TA-II manufactured by Coulter Electronics, Inc.) or a Coulter Multisizer (Model II manufactured by Coulter Electronics, Inc.). As an electrolytic solution for measurement, an aqueous 1% by weight NaCl solution of first-grade sodium chloride is used. Measurement is carried out by adding, as a dispersant, 0.1–5 ml of a surfactant (alkylbenzenesulfonic acid salt) to 100 to 150 ml of the above electrolytic solution, and further adding 2 to 20 mg of a sample to be measured. The resulting mixture is subjected to dispersion for about 1 minute to about 3 minutes in an ultrasonic dispersing machine. The electrolytic solution (100–200 ml) is taken in another vessel, to which a predetermined amount of the dispersed sample is added so that the particle count through 1 minute is about 30,000. Using an aperture of 100 μm in the above particle size distribution measuring device, the particle size distribution is measured on the basis of the number and volume with the Coulter counter for particles having a diameter in the range of 2–40.30 μm to determine the number average particle diameter and volume average particle diameter of the toner. The following 13 channels are used: 2.00 to less than 2.52, 2.52 to less than 3.17, 3.17 to less than 4.00, 4.00 to less than 5.04, 5.04 to less than 6.35, 6.35 to less than 8.00, 8.00 to less than 10.08, 10.08 to less than 12.70, 12.70 to less than 16.00, 16.00 to less than 20.20, 20.20 to less than 25.40, 25.40 to less than 32.00, 32.00 to less than 40.30.

Measurement of Melting Point:

Measurement is carried out using RIGAKU THERMOFLEX Model TG8110 (manufactured by Rigaku Denki Co., Ltd.) at a heating rate of 10° C./min. The main maximum peak of the exothermic/endothermic curve represents the melting point.

Measurement of Tg:

Sample (about 10 mg) is placed in an aluminum vessel supported on a holder unit. This is then set in an electric oven. The sample is measured for DSC using TG-DSC system TAS-100 (manufactured by Rigaku Denki Co., Ltd.).

Thus, the sample is heated from room temperature to 150° C. at a rate of 10° C./min, maintained at 150° C. for 10 minutes and then cooled to room temperature. After being maintained at room temperature for 10 minutes, the sample is again heated to 150° C. at a heating rate of 10° C./min for DSC analysis. Using the analyzing system of TAS-100, Tg is determined from the tangential line of the endothermic curve near the Tg and the base line.

Each of the toners obtained in Examples 1–15 and Comparative Examples 1–4 was measured for minimum temperature required for fixation, temperature causing hot offset, filming on a photoconductor, fluidity, gloss and haze according to the methods described below. The results are summarized in Table 1.

(1) Minimum Temperature for Fixation and Temperature Causing Hot Offset:

A color copying machine (Preter 550 manufactured by Ricoh Company, Ltd.) is adjusted to develop with toner of 1.0±0.1 mg/cm$^2$ and modified to provide a nip width of 1.6 times as great as that of the standard by increasing the spring force of the fixing rolls and to permit variation of the fixing temperature. Copies are produced while gradually varying the temperature of the fixing roll stepwise by 5° C. in each step to determine the minimum temperature above which the toner image can be properly fixed and the temperature below which offset of toner does not occur. As the transfer paper, commercially available paper (6000-70W manufactured by Ricoh Company, Ltd.) is used. The fixation is performed with a linear speed of 180±2 mm/sec and a nip width of 10±1 mm.

(2) Filming:

After producing a predetermined number of copies, the photoconductor is observed with naked eyes to check formation of toner filming thereon. The evaluation is made according to the following ratings:

A: no filming

B: slight filming

C: significant filming (3) Fluidity:

Bulk density of toner is measured using Powder Tester (manufactured by Hosokawa Micron Inc.). Greater the bulk density, the better is the fluidity. Thus, the fluidity is evaluated in terms of the bulk density according to the following ratings:

A: bulk density≧0.35

B: 0.35>bulk density≧0.30

C: 0.30>bulk density≧0.25

D: 0.25>bulk density (4) Gloss:

A color copying machine (Preter 550 manufactured by Ricoh Company, Ltd.) is adjusted to develop with toner of 1.0±0.1 mg/cm$^2$ and modified to provide a nip width of 1.6 times as great as that of the standard by increasing the spring force of the fixing rolls. Copies are produced at a surface temperature of the fixation roll of 160° C. The gloss of the toner image is measured with a gloss meter (manufactured by Nippon Denshoku Kogyo Co., Ltd.) with incident angle of 60°. As the transfer paper, commercially available paper (6000-70W manufactured by Ricoh Company, Ltd.) is used. The greater the measured value, the higher is the gloss. A gloss of at least 10% is required in order to obtain a clear color image with good reproducibility.

(5) Haze:

A color copying machine (Preter 550 manufactured by Ricoh Company, Ltd.) is adjusted to develop with toner of 1.0±0.1 mg/cm$^2$ and modified to provide a nip width of 1.6 times as great as that of the standard by increasing the spring force of the fixing rolls. Copies are produced at a surface temperature of the fixation roll of 160° C. using OHP sheet (Tpe PPC-DX manufactured by Ricoh Company, Ltd.) as a transfer paper. The haze is measured using a direct reading haze computer (HGM-2DP manufactured by Suga Tester Co., Ltd.). Haze serves as an index showing the transparency of the toner. The smaller the measured value, the higher is the transparency and the better is the color on the OHP sheet. Namely, the color of a lower toner image layer provided below an upper toner image layer is improved when the toner image has high transparency. Haze of 30% or less, especially 20% or less, is preferred.

TABLE 1

| Example No. | Min. Fixation Temp. (° C.) | Offset (° C.) | Filming | Fluidity | Gloss | Haze |
|---|---|---|---|---|---|---|
| 1 | 140 | 220 | A | B | 24.1 | 15.5 |
| 2 | 140 | 230 | A | B | 22.3 | 18.6 |
| 3 | 140 | 210 | A | A | 26.5 | 13.2 |
| 4 | 140 | 220 | A | B | 23.9 | 14.8 |
| 5 | 145 | 220 | A | B | 23.7 | 18.4 |
| 6 | 140 | 220 | A | B | 24.6 | 17.3 |
| 7 | 140 | 220 | A | B | 25.1 | 16.1 |
| 8 | 135 | 220 | A | B | 26.1 | 15.7 |
| 9 | 130 | 200 | A | B | 28.7 | 8.3 |
| 10 | 140 | 210 | A | B | 24.9 | 10.5 |
| 11 | 150 | 220 | A | A | 20.2 | 21.6 |
| 12 | 160 | 230 | A | A | 16.4 | 23.6 |
| 13 | 140 | 220 | A | C | 25.6 | 15.2 |
| 14 | 140 | 220 | A | B | 24.8 | 14.3 |
| 15 | 140 | 220 | A | B | 23.2 | 13.5 |
| Comp. 1 | 140 | 180 | B | D | 8.5 | 35.8 |
| Comp. 2 | 140 | 190 | C | D | 16.2 | 26.7 |
| Comp. 3 | 140 | 170 | B | B | 7.4 | 40.8 |
| Comp. 4 | 140 | 230 | B | C | 23.8 | 31.2 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A toner comprising:

a colorant, a binder, and wax particles dispersed in said binder, wherein at least 70% by number of said wax particles have a dispersion diameter of 0.1–3 μm, said binder comprises at least one modified polyester and wherein said binder has an acid value of 5–20 mg KOH.

2. The toner as claimed in claim 1, wherein said binder additionally includes a non-modified polyester in such an amount that the weight ratio of said modified polyester to said non-modified polyester is in the range of 5:95 to 80–20.

3. The toner as claimed in claim 1, wherein said binder has a molecular weight distribution according to gel permeation chromatography providing a main peak in a molecular weight region of 1000 to 30,000.

4. The toner as claimed in claim 1, wherein said binder has a glass transition point of 40–700° C.

5. The toner as claimed in claim 1, wherein said modified polyester is a urea-modified polyester.

6. The toner as claimed in claim 1, having a volume average particle diameter of 3–10 μm.

7. The toner as claimed in claim 1, obtained by a method comprising:

providing an organic solvent solution or dispersion of said modified polyester resin, wax particles and colorant, dispersing said organic solvent solution or dispersion into an aqueous medium with stirring to obtain resin particles dispersed in said aqueous medium and containing said wax particles and colorant, separating and drying said resin particles.

8. The toner as claimed in claim 1, obtained by a method comprising:

providing an organic solvent solution or dispersion of a prepolymer of said modified polyester resin, said wax particles, said colorant and a reactant selected from chain extenders and crosslinking agents, dispersing said organic solvent solution or dispersion into an aqueous medium with stirring at a temperature sufficient to react said prepolymer with said reactant to form said modified polyester resin and to obtain toner particles dispersed in said aqueous medium and comprising said modified polyester resin said wax particles and colorant, separating and drying said toner particles.

9. The toner as claimed in claim 8, wherein said prepolymer is a urethane-modified polyester and said reactant is an amine.

10. The toner as claimed in claim 1, wherein said wax particles are not exposed on a surface of the toner.

11. The toner as claimed in claim 1, wherein said modified polyester is a member selected from the group consisting of a urea-modified polyester, a graft polymer modified polyester, a polyester cross-linked by free radicals in the presence of a monomer having two unsaturated groups, a polyester copolymerized with another resin, and a polyester reacted with another resin.

12. The toner as claimed in claim 11, wherein said modified polyester is a urea-modified polyester.

13. The toner as claimed in claim 12, wherein the urea-modified polyester is prepared by reacting a diol and optionally a polyol with a dicarboxylic acid and optionally a poly acid to form a base polyester, reacting the base polyester with a polyisocyanate to form a polyester prepolymer, then reacting the polyester prepolymer with an amine.

14. The toner as claimed in claim 13, wherein the diol is selected from the group consisting of an alkylene glycol having 2–12 carbon atoms, an alkylene oxide adduct of a bisphenol, and mixtures thereof.

15. The toner as claimed in claim 13, wherein the dicarboxylic acid is selected from the group consisting of alkylene dicarboxylic acids having 4–20 carbon atoms, anhydrides or alkyl esters of alkylene dicarboxylic acids having 4–20 carbon atoms, aromatic dicarboxylic acids having 8–20 carbon atoms, and anhydrides or alkyl esters of aromatic dicarboxylic acids having 8–20 carbon atoms.

16. The toner as claimed in claim 13, wherein the polyisocyanate is selected from the group consisting of tetramethylene diisocyanate; hexamethylene diisocyanate; 2,6-diisocyanate methylcaproate; isophorone diisocyanate; cyclohexylmethane diisocyanate; tolylene diisocyanate; diphenylmethane diisocyanate; $\alpha,\alpha,\alpha',\alpha'$-tetramethylxylylene diisocyanate; an isocyanurate; any of the preceeding polyisocyanates blocked or protected with a phenol, an oxime, or a caprolactam; and mixtures thereof.

17. The toner as claimed in claim 13, wherein the amine is selected from the group consisting of a diamine, a polyamine having three or more amine groups, an aminoalcohol, an aminomercaptan, an amino acid, and any of the preceeding amines which are blocked or protected.

18. The toner as claimed in claim 1, further comprising a polymer selected from the group consisting of homopolymers of styrene or a substituted styrene; a styrene-based copolymer; polymethyl methacrylate, polybutyl methacrylate, polyvinyl chloride, polyvinyl acetate, polyethylene, polypropylene, polyvinylbutyl butyral, polyacrylic resin, rosin, modified rosin, terpene resin, phenolic resin, aliphatic hydrocarbon resin, alicyclic hydrocarbon resin, aromatic petroleum resin, chlorinated paraffin, paraffin wax, and mixtures thereof.

19. The toner as claimed in claim 1, further comprising a charge controlling agent.

20. The toner as claimed in claim 1, further comprising a fluidizing agent.

21. An image forming method comprising:

developing an electrostatic image with a dry toner according to claim 1 to form a toner image;

transferring the toner image to a transfer medium; and fixing the transferred toner image on the transfer medium.

* * * * *

UNITED STATES PATENT AND TRADEMARK OFFICE

CERTIFICATE OF CORRECTION

PATENT NO. : 6,800,412 B2
DATED : October 5, 2004
INVENTOR(S) : Sugiyama et al.

It is certified that error appears in the above-identified patent and that said Letters Patent is hereby corrected as shown below:

Title page,
Insert the following items:
-- [45] Date of Patent: * Oct. 5, 2004
[*] Notice: Subject to any disclaimer, the term of this patent is extended or adjusted under 35 U.S.C. 154(b) by 0 days.

This Patent is subject to a terminal disclaimer. --

Signed and Sealed this

Fourteenth Day of December, 2004

JON W. DUDAS
*Director of the United States Patent and Trademark Office*